US007563126B2

(12) United States Patent
Blanchot

(10) Patent No.: US 7,563,126 B2
(45) Date of Patent: Jul. 21, 2009

(54) TERMINAL BOARD COMPONENT AND SCREWLESS CONNECTOR

(75) Inventor: Michéle Blanchot, Cravent (FR)

(73) Assignee: Professional General Electronic Products PGEP, Courbevoie (FR)

( * ) Notice: Subject to any disclaimer, the term of this patent is extended or adjusted under 35 U.S.C. 154(b) by 48 days.

(21) Appl. No.: 11/666,286

(22) PCT Filed: Oct. 26, 2005

(86) PCT No.: PCT/FR2005/002678

§ 371 (c)(1),
(2), (4) Date: Jul. 18, 2007

(87) PCT Pub. No.: WO2006/048530

PCT Pub. Date: May 11, 2006

(65) Prior Publication Data

US 2008/0124988 A1 May 29, 2008

(30) Foreign Application Priority Data

Oct. 28, 2004 (FR) ..... 04 11552

(51) Int. Cl.
*H01R 4/24* (2006.01)

(52) U.S. Cl. ..... 439/440; 439/441

(58) Field of Classification Search ..... 439/440, 439/441

See application file for complete search history.

(56) References Cited

U.S. PATENT DOCUMENTS

| | | | | |
|---|---|---|---|---|
| 5,685,735 | A * | 11/1997 | Hohorst | 439/441 |
| 6,336,824 | B1 | 1/2002 | Sorig | |
| 6,682,364 | B2 * | 1/2004 | Cisey | 439/441 |
| 7,004,781 | B2 * | 2/2006 | Walter | 439/441 |
| 2002/0155750 | A1 | 10/2002 | Beege et al. | |

FOREIGN PATENT DOCUMENTS

| | | |
|---|---|---|
| DE | 7719374 | 9/1977 |
| DE | 19949387 | 5/2001 |
| EP | 0837526 | 4/1998 |
| EP | 1124286 | 8/2001 |

* cited by examiner

*Primary Examiner*—Tho D Ta
(74) *Attorney, Agent, or Firm*—Young & Thompson

(57) ABSTRACT

The terminal board component is composed of a box traversed by electrical current-carrying elements (30), with an end surface (110) bearing mechanical (111) and electrical (114) connection elements allowing its attachment to a modular component of an electrical device and one end surface (150) bearing elements for connection to at least one electric power cable. The box includes at least one housing (104) for accommodating a connection element designed to be electrically connected to at least one electric power cable. The connection elements is a screwless connector (4), and the box bears a plunger (136, 137, 138) that is obtained by molding with its upper surface (13, 113) and that is movable perpendicular to the upper surface (113), positioned over each housing (104) for accommodating a screwless connector (4).

20 Claims, 2 Drawing Sheets

TERMINAL BOARD COMPONENT AND SCREWLESS CONNECTOR

BACKGROUND OF THE INVENTION

1. Field of the Invention

Figure 1:
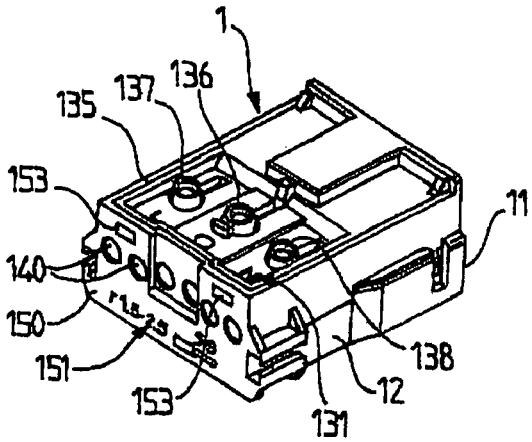

This invention generally relates to an electrical device composed of an assembly of modular components and more exactly to a terminal board designed to be used to connect such a device to an electric power circuit.

2. Description of the Related Art

In the conventional manner, modular components are provided on their ends with mechanical and electrical connection means in order to be connected to one another in succession by engagement, and each supports a defined electrical function, for example receptacle(s), breaker, switch, indicator light, lightning arrester, . . . .

The consumer builds or forms an electrical device similar to a strip with the electrical functions that are necessary to it by connecting suitable modular components to one another.

Modular components with a terminal board function are installed on the end of the assembly to allow connection to electric power cables. These components that form the terminal board bear means of mechanical and electrical connection to other modular components on one end surface, whereas the other end surface allows access of electrical cables to power supply connection means.

These terminal boards have the form of a box containing one or more connection means designed to be electrically connected to electrical cables.

Conventionally, ordinary connection means are of the set-screw type or are screwless.

Set-screw type connection means comprise a cylindrical opening in which the conductor cable is kept in position by a set screw extending diametrically in said opening.

The screwless connection means, often called harpoon-type connectors, comprise elastic means that allow introduction of the conductor, but prevent it from being pulled out.

No matter the type of connection means, a tool is necessary to disconnect cables when changing the installation; on the one hand, this requires a passage opening for the tool in the wall of the terminal board, a source of degradation of electrical safety of the box, and, on the other hand, comprises lost time during interventions.

SUMMARY OF THE INVENTION

This invention suggests a modular component that forms a terminal board that does not require a tool for disconnecting power distribution cables such that the electrical safety is maintained and interventions are simple and prompt.

For this purpose, the invention relates to a terminal board component for an electrical device composed of an assembly of modular components provided on their ends with mechanical and electrical connection means, said terminal board component being composed of a box traversed by electrical current-carrying means, with an end surface bearing mechanical and electrical connection means allowing its attachment to a modular component of said electrical device and one end surface bearing means for connection to at least one electric power cable, said box comprising at least one housing for accommodating a connection means designed to be electrically connected to at least one electric power cable, characterized in that said connection means is a screwless connector and that said box bears a plunger that is obtained by molding with its upper surface and that is movable perpendicular to said upper surface, positioned over each housing for accommodating a screwless connector.

The terminal board component according to the invention is again characterized in that:

- said screwless connector is composed of a cage in which an elastic blade is located,
- the cage comprises a lower surface, a front surface, located on the end of said lower surface and perpendicular to it, an upper surface perpendicular to the front surface and parallel to the lower surface, and side surfaces located perpendicular to the upper surface and extending on both sides from the front surface in the direction of the lower surface,
- two tabs cut into the front surface of the cage extend perpendicular to said front surface, toward the interior of said cage,
- the upper surface is traversed by a central opening,
- said elastic blade is composed of a lower surface and an oblique surface separated into two parts by a groove,
- each part of the oblique surface bears on its end that is not connected to the lower surface and along the groove a lug curved in the direction of said lower surface,
- said plungers are composed of a cylinder traversing an opening of the upper surface of the terminal board and a foot,
- the contour of the section of said feet fits into the contour of the central opening of the cage,
- each plunger is carried by the end of an elastic tongue located parallel to the upper surface of the box, along the wall of the latter turned toward the interior of the box, and connected to it by its end opposite the one bearing the cylinder comprising the plunger,
- the end surface bearing the means of connection to at least one electric power cable has round cylindrical openings distributed transversely and arranged in pairs facing the housings designed for the screwless connectors.

This invention likewise relates to a screwless connector composed of a cage containing an elastic blade, characterized in that the cage has a lower surface, a front surface located on the end of said lower surface and perpendicular to it, an upper surface perpendicular to the front surface and parallel to the lower surface, and side surfaces located perpendicular to the upper surface and extending on both sides from the front surface in the direction of the lower surface, and in that two tabs cut into the front surface of the cage extend perpendicular to said front surface, toward the interior of said cage.

Said screwless connector according to the invention is again characterized in that:

- the cage has two guide passages delineated by a tab, a cutout of the front surface, the upper surface and a side surface,
- the side surfaces have a height that is less than the height of the front surface and bear extensions continuing to the lower surface and ending in hooks turned under said lower surface,
- the upper surface is traversed by a central opening,
- said elastic blade is composed of a lower surface and an oblique surface separated into two parts by a groove,
- each part of the oblique surface bears on its end—that is not connected to the lower surface and along the groove—a lug curved in the direction of said lower surface,
- the elastic blade is positioned in the cage with its lower surface on the lower surface of the cage and its oblique surface in two parts turned toward the front surface of the cage and is kept in position in said cage by the interworking of a cutout of its lower surface with a tab formed in the lower surface of the cage based on a slash, the lugs of the elastic blade are arranged under the central opening of the upper surface of the cage, the lower surface of said elastic blade has a corrugated part.

In the following description, we will call the modular component forming the terminal board a terminal board.

BRIEF DESCRIPTION OF THE DRAWING FIGURES

Figure 2:
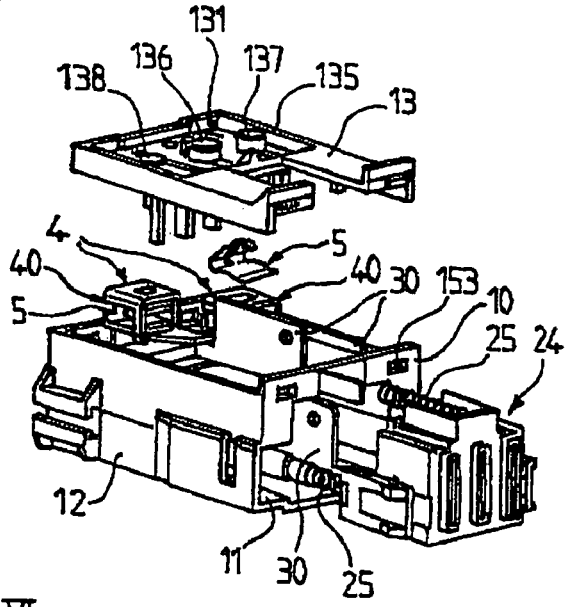
Figure 3:
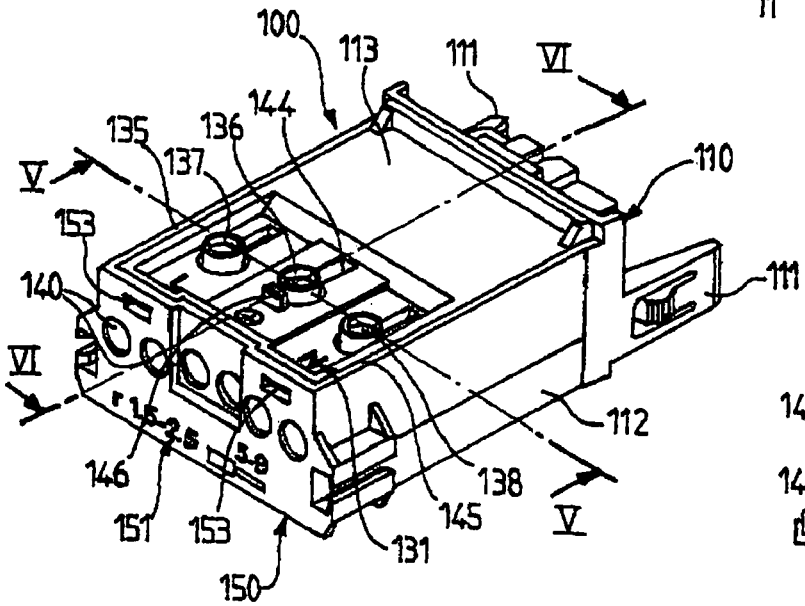
Figure 5:
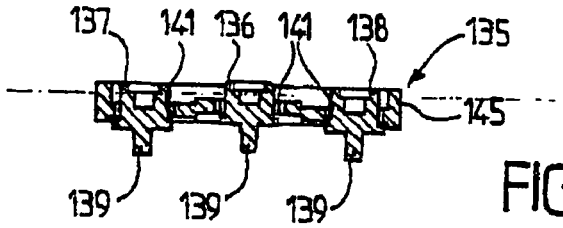
Figure 6:
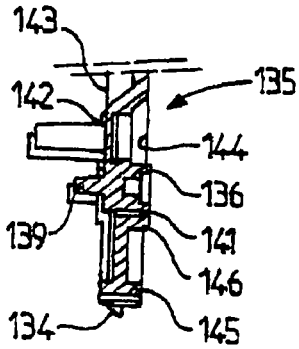
Figure 4:
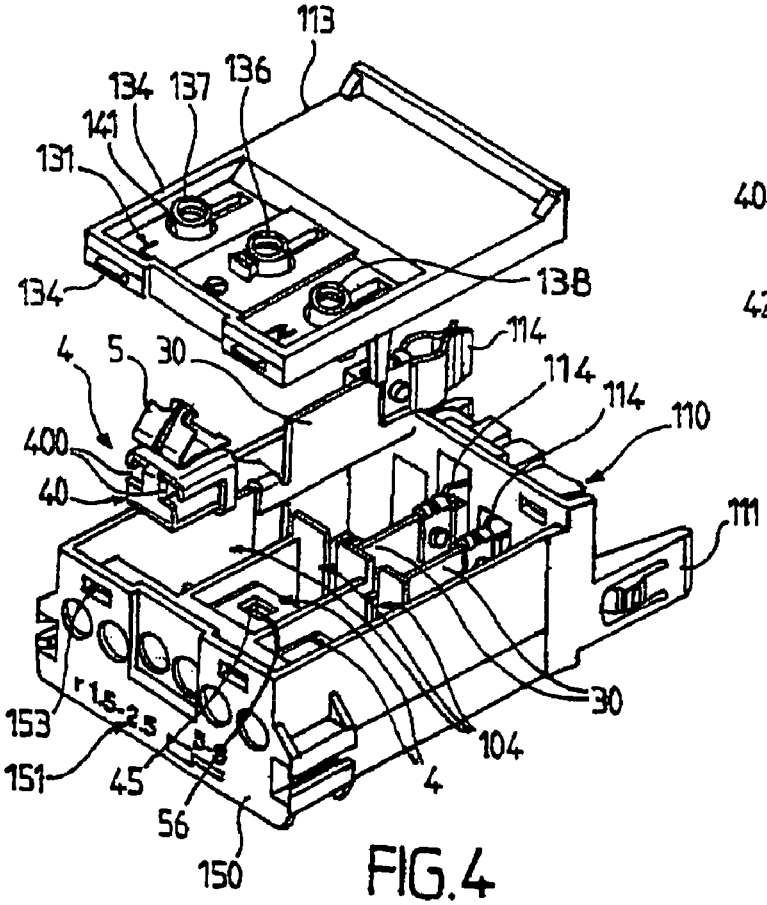
Figure 7:
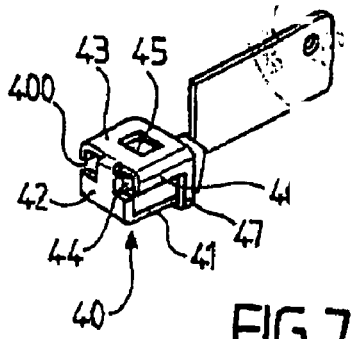
Figure 8:
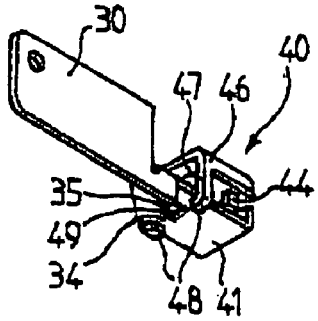
Figure 9:
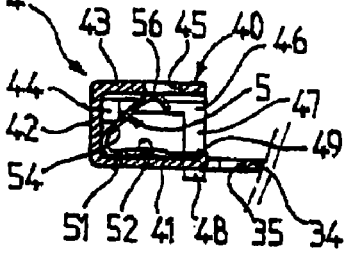
Figure 10:
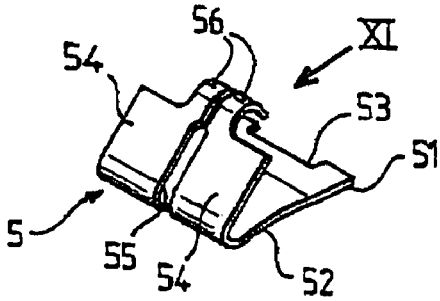
Figure 11:
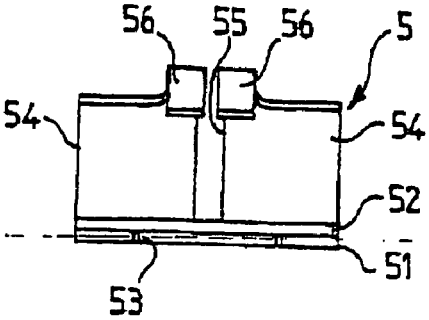
Figure 12:
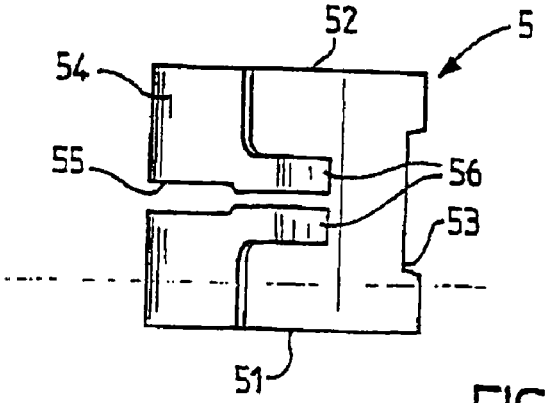

The invention will be better understood from the following description given by way of nonlimiting example with reference to the accompanying drawings in which:

FIG. 1 is a perspective view, from the front of the cable insertion surface, of a terminal board according to a first embodiment of the invention, FIG. 2 is an exploded perspective view, from the surface opposite the cable insertion surface, of a terminal board according to a first embodiment of the invention, FIG. 3 is a view, similar to FIG. 1, of a terminal board according to a second embodiment of the invention, FIG. 4 is an exploded perspective view corresponding to FIG. 3, FIG. 5 is a cutaway view of the upper surface of the terminal board according to the first embodiment of the invention along line V-V of FIG. 3, FIG. 6 is a partial cutaway view of the upper surface of the terminal board according to the first embodiment of the invention along line VI-VI of FIG. 3, FIGS. 7 and 8 are perspective views of the surface and bottom respectively of the screwless connector formed on the end of a power supply bus, FIG. 9 is a longitudinal cutaway view of a screwless connector, FIG. 10 is a perspective view of the elastic blade positioned in the screwless connector, FIG. 11 is a view along the arrow XI of the elastic blade of FIG. 10, FIG. 12 is a top view of the elastic blade from FIG. 10.

DETAILED DESCRIPTION OF THE INVENTION

In the embodiments shown in the drawings by way of nonlimiting examples, the terminal boards according to the invention are designed for equipment in which each modular component bears on a first end surface female electrical connection components and male mechanical connection components, whereas the second end surface bears male electrical connection components and female mechanical connection components.

The end surface 10 of the terminal board 1 shown in FIGS. 1 and 2 bears female mechanical connection means 11, only one of which is shown in the drawings, each positioned along a side surface 12, and male electrical connection means, composed of the ends of current busses 30 to allow the connection of said terminal board to the first end surface of a modular component.

In the example shown in the drawings, the end surface 10 bearing the mechanical and electrical connection means of the terminal board 1 is equipped with a spring (25)-operated safety unit 24 that pushes it toward the outside of the terminal board. This safety unit covers the male electrical connection means 30 when the terminal board 1 is not connected to a modular component and is pushed toward the interior of the terminal board as a modular component is being moved closer, such that the ends of the current busses 30 are disengaged and connected to the female electrical connection means of said modular component. During this connection of the terminal board and the modular component, the ends of the current busses 30 are never accessible from the outside of the components, which eliminates any possibility of contact of an external object with said current busses 30.

In the terminal board 100 shown in FIGS. 3 and 4, the end surface 110 bears male mechanical connection means 111, one on the end of each side surface 112, and female electrical connection means 114, the clips 114 located on the ends of the current busses 30 in order to allow connection of said terminal board to the second end surface of a modular component.

On the end surface that does not bear mechanical and electrical connection means, the terminal board of an electrical device composed of an assembly of modular components has means for connection to electric power cables.

According to the invention, the connection means of the electric power cables positioned in the terminal boards are composed of screwless connectors 4 that are borne by the current busses 30.

These screwless connectors 4 will now be described in detail before completing the description of the means implemented in the terminal board according to the invention, based on their use.

Said screwless connectors 4 are composed on the whole of a cage 40 in which an elastic blade 5 is placed.

As is apparent in the drawings and more especially in FIGS. 7 to 9, the cage 40 comprises a lower surface 41 formed in the extension of one flat end 34 located perpendicular to the general plane of the current bus 30. Said flat end 34 is obtained by folding the metallic flange comprising said current bus 30.

As shown in the drawings, a tab 49 formed from a slash 35 of the flat end 34 of the current bus 30 is turned toward the interior of the cage 40.

The cage 40 again comprises a front surface 42 located on the end of the lower surface opposite the current bus 30 and perpendicular to said lower surface 41, and an upper surface 43 perpendicular to the front surface 42 and parallel to the lower surface 41.

Two tabs 44 are cut into the front surface 42 and folded toward the interior of the cage 40 to extend perpendicular to said front surface 42.

The front surface 42 accordingly has the shape of an inverted T.

The upper surface 43 is traversed by a central opening 45 with a square cross-section in the embodiment shown in the drawings.

Side surfaces 46 located perpendicular to the upper surface 43 extend on both sides from the front surface 42 in the direction of the lower surface 41. These side surfaces 46, in the example shown in the drawing, are of a height that is less than the height of the front surface 42 and bear extensions 47 that continue as far as the lower surface 41 and end in hooks 48 turned under said lower surface 41.

This composition of the cage 40 allows two guide passages 400 to be formed that are delineated by a tab 44, a cutout of the front surface 42, the upper surface 43 and a side surface 46.

The elastic blade 5 shown in FIGS. 10 to 12 is composed of a lower surface 51 and an oblique surface separated into two parts 54 by a groove 55.

Each part 54 of the oblique surface bears on its end that is not connected to the lower surface 51 and along the groove 55 a lug 56 that is curved in the direction of said lower surface 51.

As shown in FIGS. 9 and 4, said lugs are arranged under the central opening 54 of the upper surface 43 of the cage 40 when the elastic blade 5 is positioned in said cage 40.

The elastic blade 5 is positioned in the cage 40 with its lower surface 51 on the lower surface 41 of the cage and its oblique surface in two parts 54 turned toward the front surface 42 of the cage 40. Said elastic blade 5 is kept in position in the cage 40 by the interworking of a cutout 53 of its lower surface 51 with a lug 49 of the cage 40.

To improve the elastic characteristics of the elastic blade 5, its lower surface 51 has a corrugated part 52.

To connect an electric power cable that is not shown in the drawings, its stripped end is inserted into one of the passages 400 of the cage 40. The walls surrounding the passages 400 precisely guide the stripped end of the cable that strikes one part 54 of the oblique surface of the elastic blade 5 and turns it toward the lower surface 51, opposing its elastic force.

The elastic blade 5 applies a force to the cable that pins it against the upper surface 43 and supports the connection of said cable to the screwless connection means 4 of the invention. Any movement tending to pull said cable out of the cage 40 is blocked by the elastic blade 5.

Supplementary means implemented in the terminal boards according to the invention to work with the screwless connection means 4 will now be described with reference to FIGS. 1 to 6.

The end surface 150 of the terminal boards by which the cables are inserted as well as the portion 135 of the upper surface 13, 113 near it are identical for the terminal boards 1, 2 according to two embodiments; consequently we will use the same references for these components.

In the conventional manner, walls formed during molding of said boxes comprising each terminal board 1, 2 support positioning and separation of the current busses 30 and of the connectors for the power supply cables that they carry.

Said end surface 150 has six round cylindrical openings 140 distributed transversely; these openings 140 are arranged in pairs facing the housings designed for the screwless connectors 4.

When said screwless connectors 4 according to the invention are positioned in the housings 104 defined by said walls of the box, each of the openings 140 faces a passage 400 of a cage 40.

By its insertion into an opening 140, a power supply cable is arranged precisely facing a passage 400 of the cage 40 that guides it inside the corresponding screwless connector 4.

The terminal boards according to the invention are more advantageous in that during modifications of the installation, they allow a power supply cable to be removed without a tool such as a screwdriver.

For this purpose, the portion 135 of the upper surface 13, 113 of the terminal board 1, 2 that is near the end surface 150 by which the terminal board is connected to the power supply cables bears three plungers 136, 137 and 138 that are obtained by molding to said upper surface 13, 113 and that are movable perpendicular to the latter.

These plungers 136, 137, and 138 are designed respectively to allow disconnection of the cables from the ground, from the line and from the neutral conductor and are positioned above the housings 104 defined by the walls for accommodating the screwless connectors 4.

As shown in FIGS. 5 and 6, said plungers 136, 137, and 138 are composed of a cylinder 136, 137 and 138 traversing an opening 141 of the portion 135 of the upper surface of the terminal board and a foot 139 with a diameter that is smaller than that of said cylinder 136, 137 and 138.

For reasons that will be described below, the contour of the section of said feet 139 can be fitted into the contour of the central opening 45 of the cage 40.

Said feet 139 can then be inserted into a central opening 45 of the cage 40.

The plungers 136, 137 and 138 are formed to be able to move perpendicular to the upper surface of the terminal board. For this purpose, each of said plungers 136, 137 and 138 is carried by the end of an elastic tongue 142 located parallel to the upper surface of the box, along the wall of the surface turned toward the interior of the box, and connected to the latter by its end 143 opposite the one bearing the cylinder comprising the plunger. In the conventional manner, the openings 144 of the upper surface allow said elastic tongues 142 to be produced by molding.

By virtue of these arrangements, each plunger 136, 137 and 138 is located with its foot 139 on the vertical of the central opening 45 of a cage 40 of the screwless connector 4.

Pressing on one of these plungers 136, 137 and 138 allows it to be moved perpendicular to the upper surface of the terminal board and in the direction of the interior of said terminal board.

Such a movement inserts the foot 139 of said plunger through the opening 45 of the cage of the connector such that said foot 139 presses on the lugs 56 of the elastic blade 5 of the connector. The elastic blade 5 is thus deformed, the parts 54 of its oblique surface coming closer from its lower surface 51 and thus releasing the power cable(s) connected to the screwless connector 4 corresponding to the action of pinning it against the upper surface 43 of the cage 40.

It is then sufficient to pull the cable(s) toward the outside of the terminal board to disconnect them.

As shown in the drawings, the plungers 137, 138 positioned near the edge of the upper surface 13, 113 have their upper surface in the same plane as the edge 145 of said upper surface. This arrangement prevents unintentional pressing on said plungers.

It is for the same safety reason that a boss 146 is formed in front of the plunger 136 corresponding to the grounding that is located in the middle of the upper surface 13, 113, thus easily accessible even unintentionally, the more so, due to the internal installation stresses of the box, that said plunger 136 is located higher than the other two plungers.

Usually, the upper surfaces 13, 113 bear lugs 134 designed to be positioned in openings 153 of the end surfaces 10, 150 of the terminal board.

As shown at 131 and 151, technical specifications required by current standards are written on the terminal board and are molded with the walls of the latter.

Advantageously, among the modular components designed for the structure by assembly of an electrical device, two terminal boards according to the invention are suggested. It is thus possible to provide for connection to power supply cables on one end or the other of the device depending on the environment in which installation must be done.

The invention claimed is:

1. A terminal board component for an electrical device similar to a strip composed of an assembly of modular components connected to one another in succession by engagement, the modular components being provided on their ends with mechanical and electrical connection means, said terminal board component being composed of a box traversed by electrical current-carrying means (30), with an end surface (10, 110) bearing mechanical (11, 111) and electrical (30, 114) connection means allowing its attachment to the modular component of said electrical device and one end surface (150) bearing means for connection to at least one electric power cable, said box comprising at least one housing (104) for accommodating a connection means designed to be electrically connected to at least one electric power cable, wherein said connection means is a screwless connector (4) and that said box bears plungers (136, 137, 138) that are obtained by molding with its upper surface (13, 113) and that are movable perpendicular to said upper surface (13, 113), positioned above each housing (104) for accommodating a screwless connector (4).

2. The terminal board component according to claim 1, wherein said screwless connector (4) is composed of a cage (40) in which an elastic blade (5) is located.

3. The terminal board component according to claim 2, wherein the cage (40) comprises a lower surface (41), a front surface (42) located on the end of said lower surface (41) and perpendicular to it, an upper surface (43) perpendicular to the front surface (42) and parallel to the lower surface (41), and side surfaces (46) located perpendicular to the upper surface (43) and extending on both sides from the front surface (42) in the direction of the lower surface (41).

4. The terminal board component according to claim 3, wherein two tabs (44) that cut into the front surface (42) of the cage (40) extend perpendicular to said front surface (42), toward the interior of said cage (40).

5. The terminal board component according to claim 3, wherein the upper surface (43) is traversed by a central opening (45).

6. The terminal board component according to claim 2, wherein said elastic blade (5) is composed of a lower surface (51) and an oblique surface separated into two parts (54) by a groove (55).

7. The terminal board component according to claim 6, wherein each part (54) of the oblique surface bears—on its end that is not connected to the lower surface (51) and along the groove (55)—a lug (56) that is curved in the direction of said lower surface (51).

8. The terminal board component according to claim 5, wherein said plungers (136, 137, 138) are composed of a cylinder traversing an opening (141) of the upper surface (13, 113) of the terminal board and a foot (139).

9. The terminal board component according to claim 8, wherein the contour of the section of said feet (139) fits into the contour of the central opening (45) of the cage (40).

10. The terminal board component according to claim 1, wherein each plunger (136, 137, 138) is carried by the end of an elastic tongue (142) located parallel to the upper surface (13, 113) of the box, along the wall of the latter turned toward the interior of the box, and connected to it by its end (143) opposite the one bearing the cylinder comprising the plunger.

11. The terminal board component according to claim 1, wherein the end surface (150) bearing the means of connection to at least one electric power cable has round cylindrical openings (140) distributed transversely and arranged in pairs facing the housings (104) designed for the screwless connectors (4).

12. A screwless connector composed of a cage (40) in which an elastic blade (5) is placed, wherein the cage (40) comprises a lower surface (41), a front surface (42) located on the end of said lower surface (41) and perpendicular to it, an upper surface (43) perpendicular to the front surface (42) and parallel to the lower surface (41), and side surfaces (46) located perpendicular to the upper surface (43) and extending on both sides from the front surface (42) in the direction of the lower surface (41), and wherein two tabs (44) cut into the front surface (42) of the cage (40) extend perpendicular to said front surface (42), toward the interior of said cage (40).

13. The screwless connector according to claim 12, wherein the cage (40) has two guide passages (400) delineated by a tab (44), a cutout of the front surface (42), the upper surface (43) and a side surface (46).

14. The screwless connector according to claim 12, wherein the side surfaces (46) have a height that is less than the height of the front surface (42) and bear extensions (47) continuing to the lower surface (41) and ending in hooks (48) turned under said lower surface (41).

15. The screwless connector according to claim 12, wherein the upper surface (43) is traversed by a central opening (45).

16. The screwless connector according to claim 12, wherein said elastic blade (5) is composed of a lower surface (51) and an oblique surface separated into two parts (54) by a groove (55).

17. The screwless connector according to claim 16, wherein each part (54) of the oblique surface bears—on its end that is not connected to the lower surface (51) and along the groove (55)—a lug (56) that is curved in the direction of said lower surface (51).

18. The screwless connector according to claim 17, wherein the elastic blade (5) is positioned in the cage (40) with its lower surface (51) on the lower surface (41) of the cage (40) and its oblique surface in two parts (54) turned toward the front surface (42) of the cage (40) and is kept in position in said cage (40) by the interworking of a cutout (53) of its lower surface (51) with a tab (49) that is formed in the lower surface (41) of the cage (40) based on a slash (35).

19. The screwless connector according to claim 18, wherein the lugs (56) of the elastic blade (5) are arranged under the central opening (45) of the upper surface (43) of the cage (40).

20. The screwless connector according to claim 16, wherein the lower surface (51) of said elastic blade (5) has a corrugated part (52).

* * * * *